US006484875B1

(12) United States Patent
Brainerd et al.

(10) Patent No.: US 6,484,875 B1
(45) Date of Patent: Nov. 26, 2002

(54) ANTI-PILFERING PACKAGING ASSEMBLY

(75) Inventors: Michael Brainerd, Franklin, WI (US); Debbie Groshek, Kenosha, WI (US); Steve Skotzke, Oak Creek, WI (US)

(73) Assignee: S-B Power Tool Company, Broadview, IL (US)

( * ) Notice: Subject to any disclaimer, the term of this patent is extended or adjusted under 35 U.S.C. 154(b) by 0 days.

(21) Appl. No.: 09/657,734

(22) Filed: Sep. 8, 2000

(51) Int. Cl.[7] ..... B65D 75/54

(52) U.S. Cl. ..... 206/232; 206/459.5; 206/461; 206/807; 340/572.1; 340/572.9

(58) Field of Search ..... 206/232, 459.1, 206/459.5, 461–471, 807; 340/572.1–572.9

(56) References Cited

U.S. PATENT DOCUMENTS

| | | | | | |
|---|---|---|---|---|---|
| 4,016,972 | A | * | 4/1977 | Szamborski | 206/470 |
| 4,091,927 | A | * | 5/1978 | Lunsford | 206/461 |
| 4,307,803 | A | | 12/1981 | Johnson | |
| 4,499,353 | A | * | 2/1985 | Shields | 206/470 |
| 4,669,610 | A | * | 6/1987 | Linsey et al. | 206/471 |
| 4,749,082 | A | * | 6/1988 | Gardiner et al. | 206/471 |
| 4,804,984 | A | | 2/1989 | Heuer et al. | |
| 4,854,450 | A | | 8/1989 | Fisher | |
| 5,129,517 | A | | 7/1992 | Hustad | |
| 5,586,657 | A | * | 12/1996 | Ward et al. | 206/807 |
| 5,626,226 | A | * | 5/1997 | Gardiner et al. | 206/461 |
| 5,699,913 | A | | 12/1997 | Richardson | |
| 5,984,091 | A | * | 11/1999 | Orr et al. | 206/471 |
| 6,039,495 | A | * | 3/2000 | Zimmerman et al. | 206/461 |
| 6,244,444 | B1 | * | 6/2001 | Jacobus et al. | 206/470 |
| 6,276,529 | B1 | * | 8/2001 | Feehan, Jr. | 206/471 |

* cited by examiner

*Primary Examiner*—Jim Foster
(74) *Attorney, Agent, or Firm*—Greer, Burns & Crain, Ltd.

(57) ABSTRACT

The invention provides a packaging assembly including a rear panel which has a rear central portion with a rear surface and a rear skirt, and a rear peripheral flange linearly displaced from the central portion by the rear skirt. Also provided is a front panel including a front central portion with a front surface and a front skirt, and a front peripheral flange linearly displaced from the central portion by the front skirt, and the front panel is configured for nesting with the rear panel. A pocket is defined when the front and rear panels are placed in nesting engagement with each other, wherein linear displacement between the front central portion and the front peripheral flange is greater than linear displacement between the rear central portion and the rear peripheral flange. A blister on the front panel is dimensioned for receiving a product and a pocket insert is sized and configured for insertion into the pocket for confining the product within the blister.

18 Claims, 1 Drawing Sheet

ANTI-PILFERING PACKAGING ASSEMBLY

BACKGROUND OF THE INVENTION

The present invention relates to anti-pilferage packaging of merchandise sold in retail and discount stores. More particularly, the present invention relates to thermoformed packaging for relatively small merchandise and an accompanying information/advertising insert.

It is common to use thermoformed blister packaging for small merchandise. A blister is adhered to a backing substrate, typically a card or another thermoformed panel, with the merchandise enclosed between the blister and the backing substrate. The backing substrate is capable of containing instructional or advertising text, pictures, and pricing codes, while the typically transparent blister containing the merchandise is affixed to the surface of the backing substrate. This is a desirable form of packaging because, despite being packaged, customers are still able to view the product through the plastic. Also, small merchandise packaging needs to remain small enough in size to maximize use of limited shelf space, yet large enough to remain visibly appealing to customers. The larger size also prevents theft to the degree the item cannot be easily concealed and removed from the store. However, this conventional blister packaging has been susceptible to thievery, in that the blister is easily removed from the substrate and the merchandise contained therein easily pocketed. Further, pictures and text were restricted to both the size and the shape of the backing substrate.

U.S. Pat. No. 4,854,450 discloses a conventional blister package having a backing substrate containing printed text, and a transparent blister which adheres to the substrate and is shaped to receive a similarly shaped product. There is no provision for an insert to be included within the blister package, nor does the reference provide a solution to the easily removable blister which has been susceptible to thievery of goods marketed in blister packages. Therefore, this reference is subject to all of the. limitations and shortcomings of the conventional art.

It is also known in the art to use two transparent panels which nest to form a so-called clamshell container. One or both of the transparent panels are provided with a blister for containing merchandise. U.S. Pat. No. 4,804,984 discloses such a package, and further provides for a display card to be sandwiched between the two transparent panels. However, the reference is directed to packaging molded to receive a camera only. Moreover, the display card contained within the packaging must accommodate the shape of the camera in order to be sandwiched between the panels. Also, as mentioned above, pictures and text are restricted to the size and shape of the display card, and the arrangement of the pictures and text are further restricted by the cut-out camera silhouette.

U.S. Pat. No. 5,699,913 also discloses a packaging assembly which includes an insert sandwiched between two transparent panels. However, this reference does not disclose incorporating the insert as a functional feature of the packaging, nor does it even disclose packaging both the product and the insert between the same two panels. Instead, the insert is intended for informational purposes only, and the insert is not accounted for when the panels are configured. Thus, this packaging assembly cannot easily accommodate larger or irregularly shaped inserts.

Another drawback of conventional blister packaging is that any insert packaged with the product is restricted in size and configuration, because the shape and size of the insert should not interfere with the compact size and shape of the blister package. Further, the insert should not infringe upon the space allowed for the item to be encased within the packaging.

Accordingly, an object of the present invention is to provide an improved blister package which incorporates the insert as a functional component of the packaging without increasing the size of the packaging.

Another object of the present invention is to provide an improved blister package which is configured to have a pocket of a predetermined size in which an insert can be placed.

Another object of the present invention is to provide an improved blister package capable of enclosing an insert which facilitates retention of the product within the blister.

An additional object of the present invention is to provide an improved blister package wherein the size and shape of the insert is independent of the size and shape of the product to be packaged.

A further object of the present invention is to provide an improved blister package which deters theft of the packaged product by causing the blister package to be difficult to open.

Still another object of the present invention is to provide an improved blister package having an anti-theft sensor contained within the insert.

BRIEF SUMMARY OF THE INVENTION

The above-listed objects are met or exceeded by the present packaging assembly, featuring an insert which fits into a pocket configured and arranged to receive the insert, where the insert facilitates retention of the product within the blister. The present packaging assembly contains front and rear panels which mate in a nesting engagement. The front and rear panels are configured so that a pocket of a predetermined size and configuration is created when the panels nest. This pocket is dimensioned to contain or enclose a corresponding insert of similar size and configuration, which supports and confines the product within the blister, and preferably conceals an anti-theft sensor.

More specifically, the present invention provides a packaging assembly including a rear panel which includes a rear central portion with a rear surface and a rear skirt, and a rear peripheral flange linearly displaced from the central portion by the rear skirt. It also provides for a front panel which includes a front central portion with a front surface and a front skirt, and a front peripheral flange linearly displaced from the central portion by the front skirt. The front panel is configured for nesting with the rear panel. In addition, a pocket is defined when the front and rear panels are placed in nesting engagement with each other, wherein the linear displacement between the front central portion and the front peripheral flange is greater than the linear displacement between the rear central portion and the rear peripheral flange. A blister on the front panel is dimensioned for receiving a product, and an insert is sized and configured for insertion into the pocket for confining the product within the blister.

DESCRIPTION OF THE PREFERRED EMBODIMENT

Figures 1, 2, 3, 4:
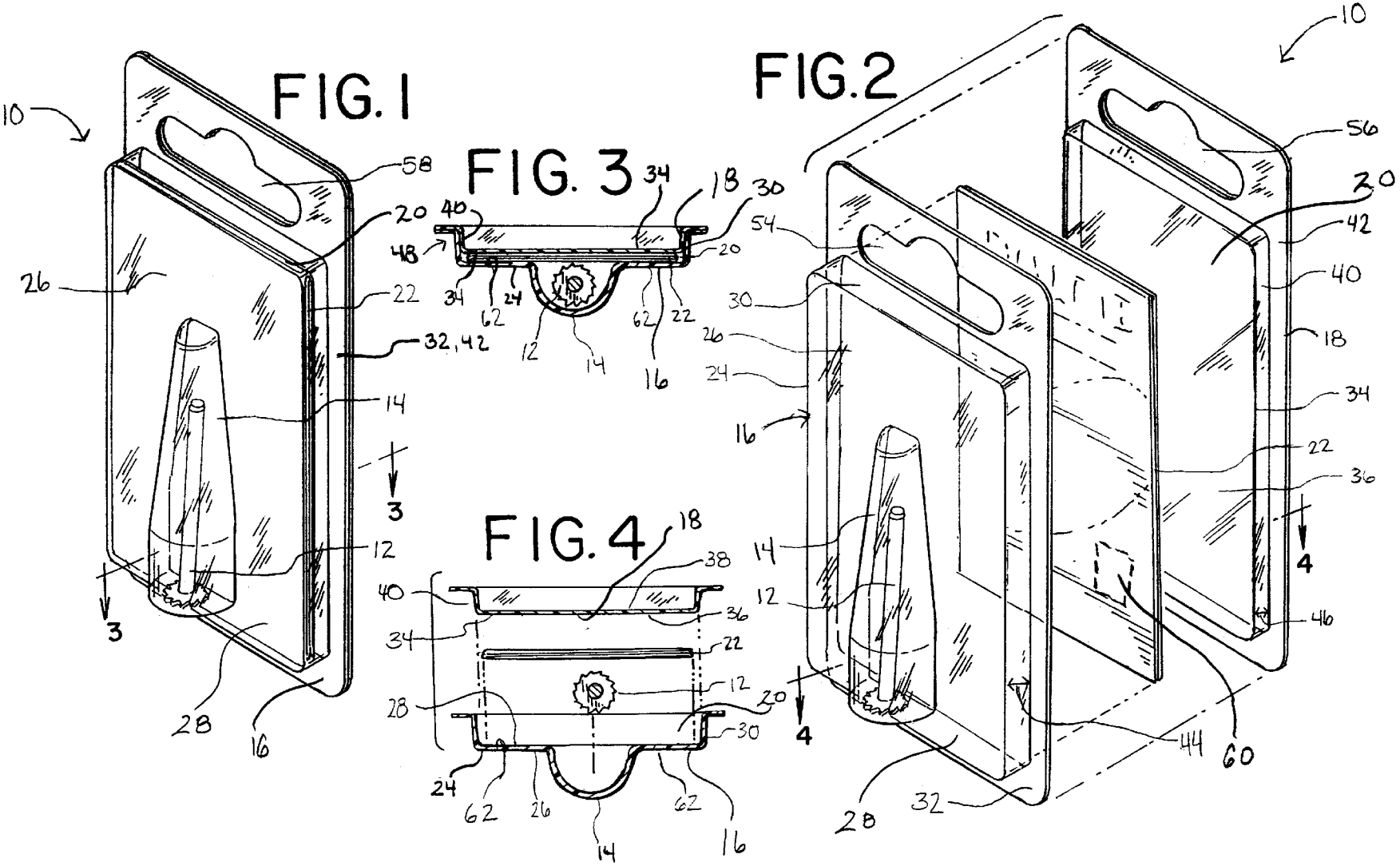
FIG. 1 is a perspective view of the present packaging assembly.
FIG. 2 is an exploded perspective view of the present packaging assembly.
FIG. 3 is a sectional view of the assembled package shown in FIG. 1 taken along the line 3—3 of FIG. 1.
FIG. 4 is an exploded sectional view taken along the line 4—4 of FIG. 2 and in the direction generally indicated.

Referring now to FIGS. 1–4, the preferred embodiment of the packaging assembly is generally designated as 10 and holds a product 12 within a blister 14 contained on a front panel 16. A rear panel 18 is configured to nest within the front panel 16, and this nesting engagement defines a pocket 20 into which a preferably folded data insert 22 is placed. The front panel 16 and rear panel 18 are preferably transparent, allowing consumers to view the folded data insert 22 though the transparent panels, preferably made from a thermoformed material such as PVC or PETG. An important feature of the present assembly is that the product 12 is confined and retained within the blister 14 by the insert 22. The insert 22 can be, among other things, a data sheet of regular or irregular configuration, either flat or folded, and inserted within the pocket 20. An advantage of this feature is that, in addition to confirming and retaining the product 12 within the blister 14, the insert 22 can be used for instructional purposes, advertising purposes, or to provide warranty information to the customer, and eliminates the need for additional inserts, die cuts, and laminated substrates.

More specifically, the front panel 16 includes a generally planar front central portion 24 with a top front surface 26, a bottom front surface 28, a front skirt 30, and a generally planar front peripheral flange 32. The front peripheral flange 32 is an optional packaging feature, formed during manufacturing when individual packaging assemblies 10 are cut from a larger batch sheet. The front peripheral flange 32 need only be large enough to ensure that the front central portion 24 remains intact during thermoforming and cutting. Increasing the size of the front peripheral flange 32 can be advantageous, however, in that increasing the size of the overall packaging assembly inhibits the ability of thieves to conceal merchandise. Decreasing the size of the flange 32, however, reduces demands on packaging materials. In the preferred embodiment, the front panel 16 and the front central portion 24 contained therein, are generally rectangular and continuous with one another, being preferably formed integrally. The blister 14 is preferably located at the center of the front central portion 24.

The rear panel 18 includes a generally planar rear central portion 34 with a top rear surface 36, a bottom rear surface 38 and a rear skirt 40, and generally planar rear peripheral flange 42. Similar to the front panel 16, the rear panel 18 and the rear central portion 34 contained therein are generally rectangular in the preferred embodiment. The front skirt 30 defines a front linear displacement 44 (FIG. 2) between the front central portion 24 and the front peripheral flange 32, and this measurement is greater than a rear linear displacement 46 between the rear central portion 34 and the rear peripheral flange 42, as defined by the rear skirt 40. Thus, when the front panel 16 and the rear panel 18 are in a nesting engagement, the pocket 20 is defined.

It is a feature of this invention that the linear displacements can be adjusted to accommodate inserts 22 of varying sizes. By simply varying the front and rear linear displacements 44, 46, the size of the insert 22 can be varied directly with the size of the pocket 20 without altering the size or shape of the packaging assembly 10. This configuration is especially advantageous as it allows the manufacturer to include as much or as little information within the packaging as desired.

In terms of product confinement and restraint, varying the thickness of the insert 22 relative to the thickness of the pocket 20 confers a biasing force in the direction of the product 12 within the blister 14, and the pocket insert thus facilitates retention of the product within the blister. This can be accomplished by varying the dimensions of the insert 22 or folding the insert. In the preferred embodiment, the insert 22 is folded one or more times, and the resulting folds exert the biasing force, which confers greater stability to the insert as a confining force upon the product 12.

The front panel 16 and rear panel 18 are held in the nesting position by frictional engagement. While nesting, the top and bottom front surfaces 26, 28 are generally parallel to the top and bottom rear surfaces 36, 38. Likewise, the front and rear skirts 30, 40 are generally parallel, and the front and rear peripheral flanges 32, 42 are generally parallel with each other. The front central portion 24 and the rear central portion 34 are adapted to be releasably secured to each other in locking condition by a snap fit locking engagement designated generally at 48. This locking engagement 48 is achieved by a frictional fit between the front central portion 24, and the rear central portion 34. The portions 24, 34, respectively, are configured in a matching back draft formation as is commonly found in the packaging art. This resilient configuration is such that as pressure is exerted on the front panel 16 and the rear panel 18 to close the package 10, the respective formations 24, 34 are pushed past each other to create the releasable locking relationship depicted in FIG. 3. In the preferred embodiment, this back draft locking arrangement is located around the entire periphery of the front and rear panels 16, 18.

A front panel aperture 54 and a rear panel aperture 56 are preferably included in the assembly 10, so that when the front and rear panels are nested, the apertures are in registry 58 (FIG. 1) for hanging display on a sales rack. Optionally, the insert 22 can contain an anti-theft sensor 60 (shown hidden), such as the anti-theft sensor commercially available from Sensormatic Electronics Corporation of Boca Raton, Fla. Preferably, this anti-theft sensor 60 adheres to the insert 22 as a sticker, and is concealed within a fold of the insert 22. Once the anti-theft sensor 60 is adhered to the inside of the folded insert 22, it is invisible through through the panels 16, 18. This sensor 60 is magnetic and triggers an alarm when the packaging assembly 10 containing the activated sensor 60 passes through an alarm preferably positioned at the entrance of a store. As is known in the art, the sensor 60 is deactivated when the Uniform Price Code (UPC) is scanned for payment at check-out. Thus, the advantage is that the alarm is only triggered when the subject merchandise has not been properly presented at check-out for payment.

Referring now to FIGS. 1, 3 and 4, the insert 22, which can be sized and configured according to the size and configuration of the pocket 20, is nestled between the rear central portion 34, the product 12. and the area defined within the front cent portion surrounding, and exclusive of, the blister 14. Since the insert 22 is in direct physical contact with the product 12 within the blister 14 and an inner surface 62 of the front panel 1 6, the insert 22 physically confines the product within the blister. The blister 14 itself can be sized and configured to correspond to the size and configuration of the product 12 intended to be encased therein. As seen in FIG. 3, the pocket 20 has a thickness defined between the inner surface 62 of the front panel 16 and the top rear surface 36 of the rear panel 18 and the insert 22 extends generally perpendicularly to a plane defined by the inner surface 62 of the front panel 16 the entire thickness of the pocket to the top rear surface 36. The insert 22 exerts a biasing force against the front and rear panels 16, 18, and accordingly contacts both the inner surface 62 and the top rear surface 36.

A feature of the present packaging assembly 10 is that the front panel 16 and the rear panel 18 are in nesting engagement, thereby defining a pocket 20 of predetermined configuration into which an insert 22 is placed. The insert 22 also serves as supportive backing for the product 12 contained within the blister 14. Upon assembly, the front peripheral flange 32 and the rear peripheral flange 42 are sealed together, preferably by RF (radio frequency) sealing or suitable chemical adhesive as is known in the art, thereby making the packaging assembly 10 tamper resistant, and difficult to quickly open and conceal for theft.

While a particular embodiment of the present packaging assembly has been shown and described, it will be appreciated by those skilled in the art that changes and modifications may be made thereto without departing from the invention in its broader aspects and as set forth in the following claims.

What is claimed is:

1. A packaging assembly comprising:

a rear panel including a rear central portion with a top rear surface, a bottom rear surface and a skirt, and a rear peripheral flange linearly displaced from said central portion by said skirt;

a front panel including a front central portion with a top front surface, a bottom front surface and a skirt, and a front peripheral flange linearly displaced from said central portion by said skirt, said front panel nesting with said rear panel;

a pocket being defined when said front and rear panels are nested with each other, wherein said linear displacement between said front central portion and said front peripheral flange is greater than said linear displacement between said rear central portion and said rear peripheral flange, said pocket having a thickness;

a blister on said front panel having a product therein;

an insert in said pocket, said insert sized and configured to exert a biasing force in the direction of the product against at least said front panel to confine and retain the product within said blister;

wherein said front panel defines a plane, said blister projects from said plane, said insert linearly spanning a gap in said plane and extends in a generally perpendicular direction to said plane the entire thickness of said pocket to retain said product in said blister.

2. The packaging assembly as recited in claim 1, wherein said insert is configured to exert a biasing force against said front and rear panels when disposed in said pocket.

3. The packaging assembly as recited in claim 2, wherein said insert comprises a folded data sheet.

4. The packaging assembly as recited in claim 1, wherein said front panel and said rear panel are in frictional engagement.

5. The packaging assembly as recited in claim 1, wherein said blister is sized and configured to receive a correspondingly sized and configured product.

6. The packaging assembly as recited in claim 1, wherein said pocket insert is provided with an anti-theft sensor.

7. The packaging assembly as recited in claim 6, wherein the anti-theft sensor is an adhesive label folded into said insert to be invisible through said panels.

8. The packaging assembly as recited in claim 1, wherein said insert is visible through said rear panel and said front panel.

9. The packaging assembly as recited in claim 1, wherein said rear panel and said front panel are transparent.

10. The packaging assembly as recited in claim 1, wherein said rear peripheral flange and said front peripheral flange are RF sealed.

11. A packaging assembly comprising:

a front panel;

a rear panel for nesting within said front panel;

a blister contained on said front panel;

a pocket defined by displacement of said front and rear panels while in nesting engagement;

an insert; and an anti-theft sensor, wherein said sensor is an adhesive label folded into said insert to be invisible through said panels.

12. The packaging assembly as recited in claim 11, wherein said pocket is sized and configured to have dimensions corresponding to the dimensions of said insert.

13. The packaging assembly as recited in claim 11, wherein said insert comprises a folded data sheet.

14. The packaging assembly as recited in claim 11, wherein said insert confines merchandise within said blister.

15. The packaging assembly as recited in claim 11, wherein said front panel and said rear panel are in frictional engagement.

16. The packaging assembly as recited in claim 11, wherein said blister is sized and configured to receive a correspondingly sized and configured product.

17. The packaging assembly as recited in claim 11, wherein said front panel and said rear panel are transparent.

18. The packaging assembly as recited in claim 11, wherein said front panel and said rear panel are RF sealed.

* * * * *